US007842879B1

(12) United States Patent
Carter

(10) Patent No.: US 7,842,879 B1
(45) Date of Patent: Nov. 30, 2010

(54) TOUCH SENSITIVE IMPACT CONTROLLED ELECTRONIC SIGNAL TRANSFER DEVICE

(76) Inventor: Paul Gregory Carter, 463 Middle Rd., Waterboro, ME (US) 04087

( * ) Notice: Subject to any disclaimer, the term of this patent is extended or adjusted under 35 U.S.C. 154(b) by 0 days.

(21) Appl. No.: 11/811,197

(22) Filed: Jun. 8, 2007

Related U.S. Application Data

(60) Provisional application No. 60/812,448, filed on Jun. 9, 2006.

(51) Int. Cl.
*G10H 3/14* (2006.01)
*G10H 1/00* (2006.01)
*G10H 1/32* (2006.01)

(52) U.S. Cl. ..... 84/730; 84/600; 84/644

(58) Field of Classification Search ..... 84/600, 84/644, 730, 743
See application file for complete search history.

(56) References Cited

U.S. PATENT DOCUMENTS

| | | | | | |
|---|---|---|---|---|---|
| 4,860,364 | A * | 8/1989 | Giannini | 84/DIG. 7 |
| 4,920,848 | A * | 5/1990 | Suzuki | 84/600 |
| 5,125,313 | A * | 6/1992 | Hiyoshi et al. | 84/600 |
| 5,290,964 | A * | 3/1994 | Hiyoshi et al. | 84/600 |
| 5,373,096 | A * | 12/1994 | Suzuki et al. | 84/600 |
| 5,403,972 | A * | 4/1995 | Valentine, Sr. | 84/730 |
| 5,434,350 | A * | 7/1995 | Haney et al. | 84/743 |
| 5,512,703 | A * | 4/1996 | Usa | 84/600 |
| 5,581,484 | A * | 12/1996 | Prince | 84/600 |
| 5,841,052 | A * | 11/1998 | Stanton | 84/600 |
| 5,856,628 | A * | 1/1999 | Noguchi et al. | 84/738 |
| 6,700,051 | B2 * | 3/2004 | Aldridge | 84/733 |
| 7,012,187 | B2 * | 3/2006 | Aldridge | 84/733 |
| 7,135,637 | B2 * | 11/2006 | Nishitani et al. | 84/723 |
| 7,381,884 | B1 * | 6/2008 | Atakhanian | 84/723 |
| 7,446,253 | B2 * | 11/2008 | Knapp et al. | 84/722 |
| 2004/0112204 | A1 * | 6/2004 | Javelle | 84/645 |
| 2007/0234888 | A1 * | 10/2007 | Rotolo de Moraes | 84/730 |
| 2008/0254824 | A1 * | 10/2008 | Moraes | 455/556.1 |
| 2009/0126554 | A1 * | 5/2009 | Xu et al. | 84/610 |

* cited by examiner

*Primary Examiner*—Jeffrey Donels
(74) *Attorney, Agent, or Firm*—Verrill Dana, LLP; Chris A. Caseiro

(57) ABSTRACT

One embodiment of the Touch sensitive impact controlled signal transfer device invention whereas the invention is used as a musical glove device that sends electrical signals to a sound module when areas of the glove containing piezoelectric discs are tapped or otherwise impacted on a surface and where the force applied by impact to the piezoelectric disc or discs is interpreted by the sound module and said module produces a sound at a volume level directly related to the force of impact on the piezoelectric discs and where multiple piezoelectric disks are located in each glove allowing a plurality of sounds by tapping different areas of the glove, such as the palm, thumb and fingers.

10 Claims, 6 Drawing Sheets

TOUCH SENSITIVE IMPACT CONTROLLED ELECTRONIC SIGNAL TRANSFER DEVICE

CROSS-REFERENCE TO RELATED APPLICATIONS

Figure 1:
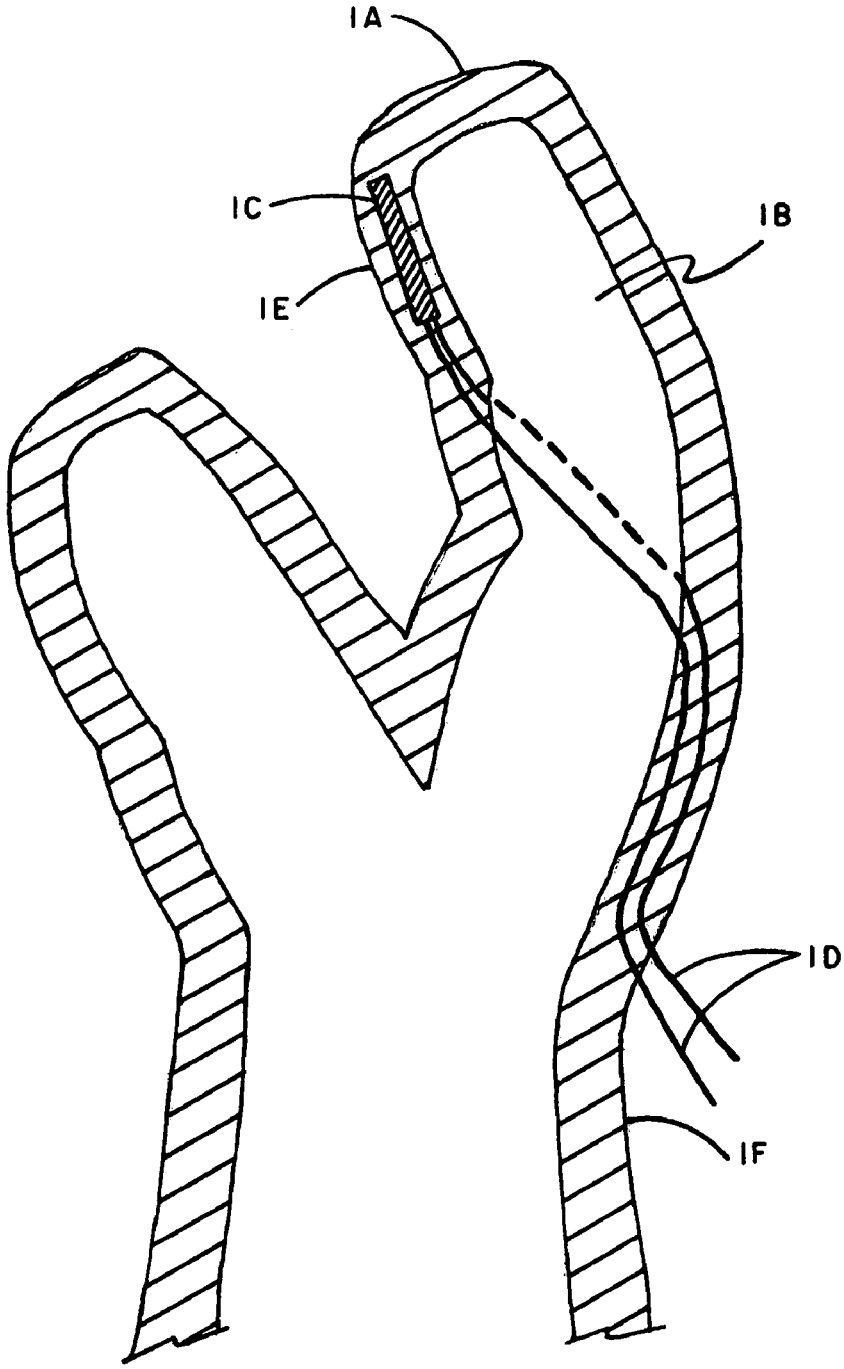

This application claims the benefit of provisional patent application Ser. No. 60/812,448 filed Jun. 9, 2006

FEDERALLY SPONSORED RESEARCH

Not Applicable

SEQUENCE LISTING OR PROGRAM

Not Applicable

BACKGROUND

1. Field of Invention

This invention relates to electronic signaling devices, specifically to an improved system for controlling the electronic input to an electronic sound module.

2. Prior Art (A) Key Board

Used for composing music tracks of Digital, MIDI, and other format. These are musical notes and sound arranged using a computer (1) Typical Computer Keyboard (a) Not fun. whether used as a hobby or for profit, it should be fun. (b) Does not lend itself well as an instrument that can used on stage or in a band (c) Keys are not touch sensitive, severely limiting musical expressions and level of attack.

(B) Drum Pads

Used for composing music tracks of Digital, MIDI, and other format. These are musical notes and sound arranged using a computer or used as an electronic musical instrument. Drum pads can also be used to play a sequence of sounds. That is to say they can be used produce or play a musical beat or melody. These drum pad devices have locations with sensors that produce a sequence of different sounds by tapping the pads with the fingers or sticks. There are three sizes of drum pads I know of through use and research.

(1) Small or Other Wise Compact Drum Pads.

These are clumsy and difficult to use for a number of reasons I have experienced. (a) The pads are too close together, which makes it difficult to play a sequence of different sounds. (b) It is hard to distinguish which pad produces each sound, as they are typically not labeled.

(c) It is hard to remember which pad produces each sound as they are typically in an arrangement that is not logical. That is to say they do not represent a musical instrument that lends itself to memory from practice.

(d) it is difficult to play a musical sequence on theses devices using both hands due to the size and close proximity of the pads to one another. In other words, the space provided is too cramped. (e) some of these drum pads are limited to the sounds produced by a sound module inside the device (f) does not lend itself well as an instrument that can used on stage or in a band (g) not fun in my opinion (2) Medium Drum Pads.

These are larger than the Compact drum pads and smaller than the standard acoustic drum set. Although they are less cramped and easier to remember, since they represent a smaller version of the acoustical drum, they lend them selves to another set of problems. (a) To play a musical sequence on these pads you need to either know how to play the drums with drum sticks or you are limited to the speed in which you can play a drum sequence, since you will be using your arm motion to move from one pad to another, (b) these medium size pads are still too small, in my opinion, to use the pads to play bongo drum sounds or other hand played percussion sounds. Someone wanting to play bongo drum sounds would in my opinion want to use full size drum pads that are specifically set up for making bongo drum sounds, which can be quite expensive.

(c) medium sized drum pads I have seen and researched have a limited number of pads supplied as part of the unit. That is to say they represent at most, a standard drum kit and limit the amount of sounds that can be produced while playing. (d) some of these drum pads are limited to the sounds produced by a sound module inside the device. (e) not fun in my opinion (3) Full Size Drum Pads Used in Electronic Drum Kits.

Full size electronic drum kits have their place, but do have some downsides. (a) They are one of the most difficult and complex instruments to move since they require disassembly and multiple pieces need to be transported and then need to be reassembled (b) They are large and bulky, taking up a lot of space (c) Parts of the drum kit can be lost or damaged if not packed and transported properly. (d) Does not lend itself as an instrument that is mobile. For instance, a guitar player, electric base player, violin player, flute player etc, can freely move about the stage while playing, whereas the drummer has to, for the most part, stay put at his drum set. (e) One needs to know the proper way to hold drums sticks which takes practice (f) One need to know how to play the drums which one of the harder instruments to learn and requires much coordination, especially hand and foot coordination (4) Other Electronic Percussion and Sound Making Devices These items all have a use, but the downsides are (a) Having a need for multiple percussion instruments such as bells, horns, wood blocks or maracas or other electronic sound makers can be expensive (b) Multiple instruments take up space and must be transported as individual instruments to avoid damage. (c) The instruments are typically held and played one or two at a time by one person.

The items listed are typically used for percussion sounds

SUMMARY

In accordance with one embodiment a touch sensitive impact controlled electronic signal transfer device is used as an electronic musical instrument whereby tapping or otherwise causing impact with the instrument generates and transfers signals to an electronic sound module for the purpose of composing music tracks and or playing music.

DRAWINGS

The features of each figure are labeled by using the figure number followed by a letter of the alphabet.

FIG. 1 Depicts the glove and one pre-wired piezoelectric component which is typical

1A shows the outer skin of a glove

1B shows the inner liner of a glove

1C shows a rubber covered piezoelectric disk

Figure 2:
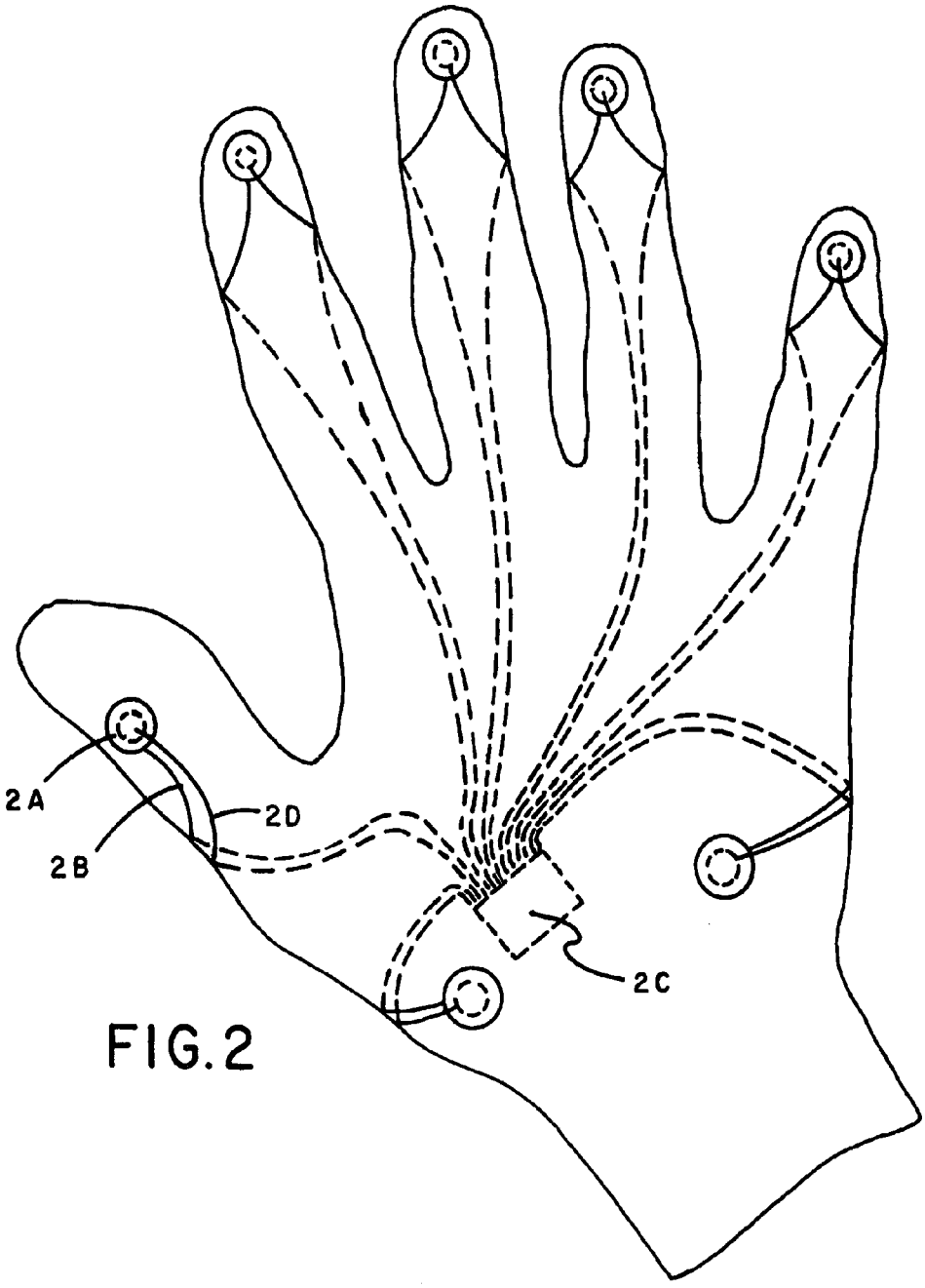
Figure 3:
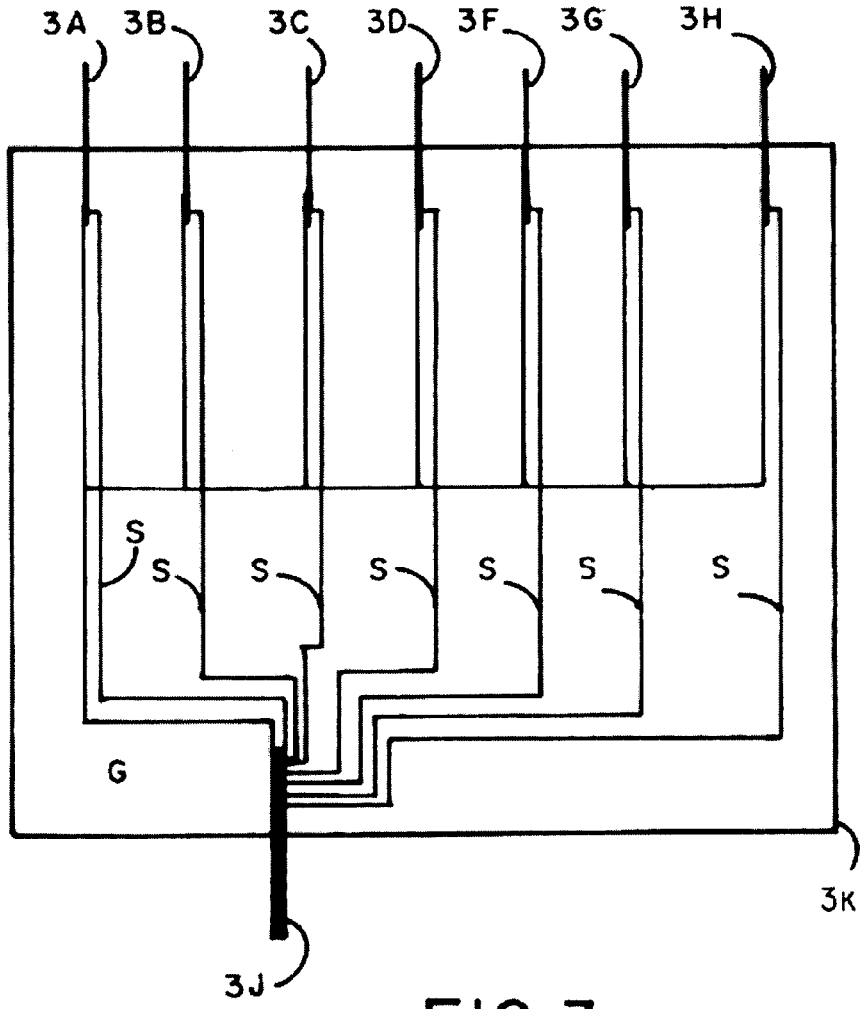
Figure 4:
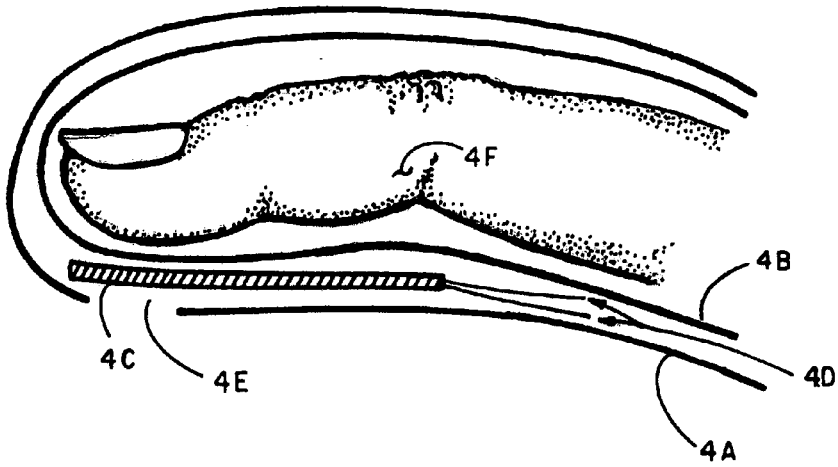
Figure 5:
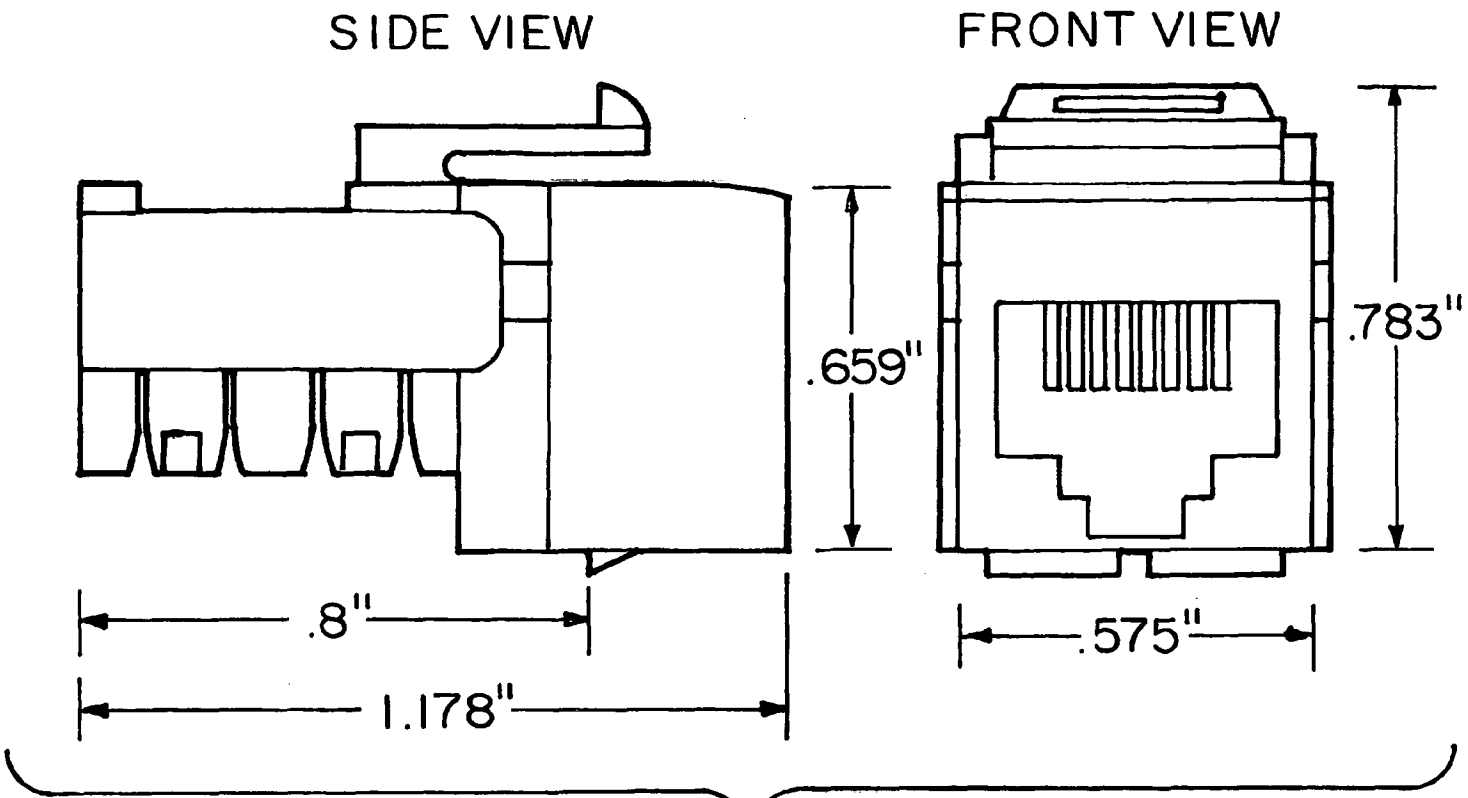
Figure 6:
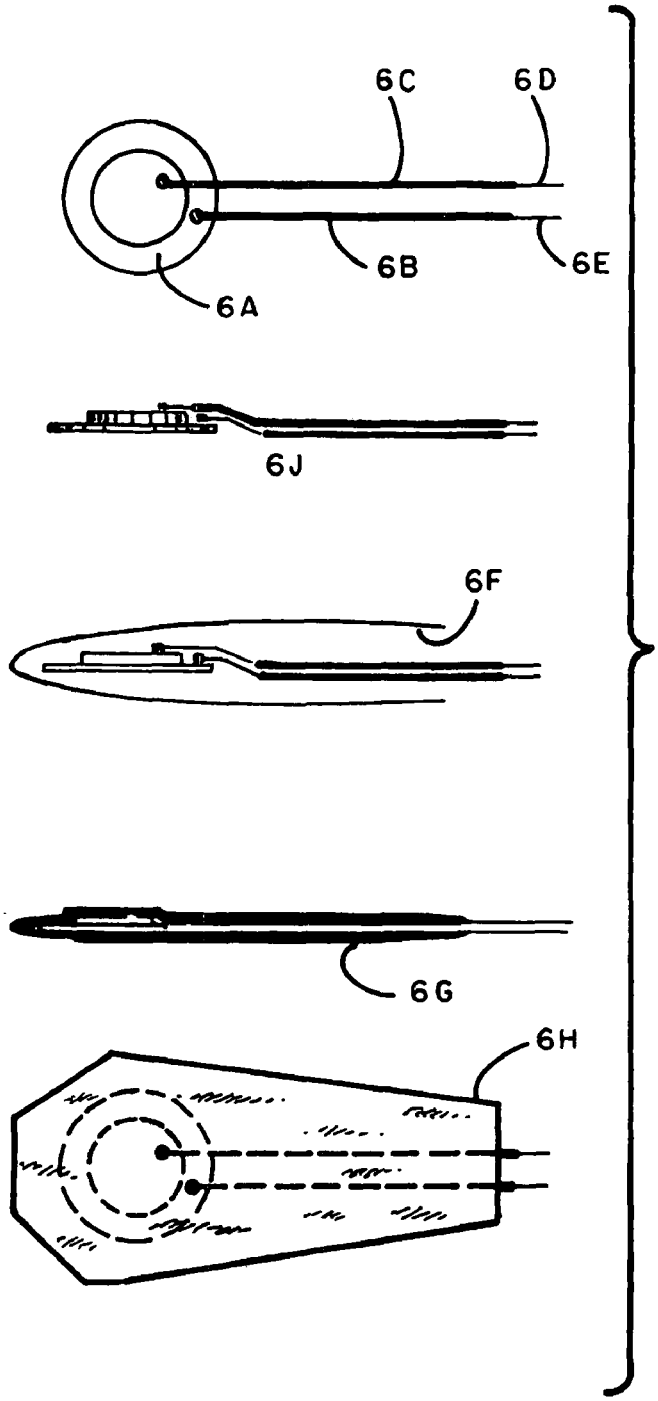

1D shows the wires connected to the piezoelectric disc with one wire located on each side of the fingers liner 1E shows the opening in the fingertip of a glove 1F shows the opening in the glove just above the wrist FIG. 2 Depicts the internal workings of the glove with its wires, piezoelectric disks and the category 5 female connector 2A shows a piezoelectric disc and is typical throughout the drawing 2B shows a ground wire and is typical throughout the drawing 2C shows a likeness of a category 5 female connector with the ground and signal wires connected to it 2D shows a signal wire and is typical throughout the drawing FIG. 3 Depicts a layman's wiring schematic of the junction between the instrument cable wires and the category 5 cable wires 3A through 3H Represent the Instrument Cables 3J represents the category 5 cable 3K represents a junction box (S) is typical and designates the signal wires (G) is Typical and designates the Ground wires FIG. 4 Depicts a finger inside the glove with its outer skin, internal liner and one pre-wired piezoelectric component which is typical 4A shows the outer skin of a glove 4B shows the inner liner of a glove 4C shows a rubber covered piezoelectric disk 4D shows the wires connected to the piezoelectric disc 4E shows the opening in the fingertip of a glove FIG. 5 is a drawing of a category5 female connector FIG. 6 Depicts the piezoelectric disc, it's components, and how it is encased in the self adhesive rubber.

6A shows the piezoelectric disc 6B shows the plastic coated portion of the ground wire of the piezoelectric disc 6C shows the plastic coated portion of the signal wire of the piezoelectric disc 6D shows the uncoated portion of the ground wire of the piezoelectric disc 6E shows the uncoated portion of the signal wire of the piezoelectric disc 6F shows the self adhesive rubber partially folded over the piezoelectric disk 6G shows the self adhesive rubber completely folded over the piezoelectric disk 6H shows a top view of the rubber covered piezoelectric disk after trimming to correct shape 6J shows a side view of the piezoelectric disk with ground and signal wire attached

DETAILED DESCRIPTION

FIGS. 1,2,3,4,5 and 6

In the preferred embodiment, the touch sensitive impact controlled signal transfer device invention is constructed by locating piezoelectric discs in areas of a glove that can be used to play drum or other musical sounds by tapping the fingers, thumb, palm or other regions of the hand as shown in FIG. 2 and the piezoelectric discs are connected to a sound module by wires, connectors and junctions.

Self adhesive rubber is folded and sealed to contain the Piezoelectric disc, the Solder connections and a portion of the wires to protect the piezoelectric disc, the piezoelectric discs solder connections and a portion of the wires that are connected to the piezoelectric discs as is shown in FIG. 6 (6F, 6G).

A leather glove with a cotton liner is used so as to encase the wires (1D, 4D) and rubber encased piezoelectric disks (1C) between the outer skin of the glove (1A, 4A) and the internal liner (1B, 4B) in a manner that keeps the wires from contacting the hand and makes it easy to put the glove on and take the glove off with damaging the wires, piezoelectric discs or the soldered connections illustrated in FIG. 4 (4A, 4B, 4C and 4F).

Openings are made in the glove to allow for insertion of wires and rubber covered piezoelectric discs (1E, 1F) The rubber encased piezoelectric disks and wires are positioned in places in the glove where it is most comfortable for tapping against a surface when used as a musical device as is shown in FIG. 2 (2A, 2B, 2C, 2D, 2E, 2E and 2F). Once the piezoelectric discs are in place, the openings in the glove can simply be sewn up or covered with a small disc of self adhesive rubber. A simple ¾" diameter disk made from the same self adhesive rubber that is used to cover the piezoelectric discs works well for this and holds the rubber encased piezoelectric disks in place as an added benefit.

The wires protrude from the glove thru an opening near the wrist (1F) on the backside of the glove where the wires are connected to a female Category 5 type network cable connection (FIG. 5), as is shown in FIG. 2 (2C).

The invention incorporates a standard network cable of Category 5 type with a male end that connects to the gloves female Category 5 type connector.

The wires contained in the Category 5 type cables are soldered or otherwise connected to the wires contained by the instrument cables that have the ¼" male instrument plugs. These plugs are used to connect the piezoelectric discs in the glove to the sound module.

The junction between the Category 5 cable wires and the instrument cable wires is contained within a junction box.

See FIG. 3 Category 5 cable (3J), Instrument cables (3A, 3B,3C,3D,3E,3F,3G and 3H), ground wires (G), Signal wires (S) and Junction box (3K).

The instrument cables connect to the inputs of a sound module, which is a commercially available item. The sound module connects to an amplified speaker system, which is a commercially available item.

Operation of the Touch Sensitive Impact Controlled Signal Transfer Device Invention:

Preferred Embodiment

Music Playing Device

The touch sensitive impact controlled signal transfer device has several piezoelectric discs, which enables the user of the touch sensitive impact controlled signal transfer device to play musical instrument sounds, Drum sounds and or other sounds by tapping his fingers thumb, palm or other parts of the hand.

Since the touch sensitive impact controlled signal transfer device has been arranged to be used as a music playing device and it must be connected a sound module and the amplified speaker system or other suitable electronic device capable of producing sound.

The touch sensitive impact controlled signal transfer device is connected to the sound module by wires and plugs.

The Instrument sound is selected by making an Instrument selection using a feature of the sound module.

The note of the sound is selected by making a note selection using a feature of the sound module.

The Piezoelectric discs in the touch sensitive impact controlled signal transfer device work in such a manner that a sound will be played for the amount of time that is selected by the user selecting a decay and/or duration setting using a feature of the sound module. The sound module has inputs for the instrument cables with plugs that are connected to the touch sensitive impact controlled signal transfer device.

The sound module should be connected to a sound producing device such as an amplified speaker system or other suitable electronic device capable of producing sound. Although sound can be heard playing through the sound module alone, it is very low volume because the sound module will typically contain a preamplifier, but not an amplifier.

Once the user has connected the touch sensitive impact controlled signal transfer device to the sound module and connected the sound module to the amplified speaker system or other suitable electronic device capable of producing sound, the user must turn on the power switches to the sound module and amplified speaker system or other suitable electronic device capable of producing sound.

Once the sound module and the amplified speaker system or other suitable electronic device capable of producing sounds power is turned on, the user can play music by tapping fingers or the other areas of the glove where the piezoelectric discs are by using the default settings in the sound module or the user can make adjustments and use custom settings by changing the instrument settings on the sound module for any of the piezoelectric discs in the glove.

CONCLUSION, RAMIFICATIONS AND SCOPE

As the reader will see, The touch sensitive impact controlled signal transfer device in its preferred and current embodiment (current embodiment meaning the prototype I have designed and built) allows the user to play the instrument on any surface and allows the user to be more interactive with an audience.

ADVANTAGES

The invention is lightweight and can be transported much easier than many musical instruments.

The invention can be carried in one hand and stored in a small space.

It can be used to replace several instruments and creates the same quality sound as digital electronic musical instruments accepted and currently used by musicians.

The invention creates a new way to play music.

The user can play real drum sounds, for instance, on a table, stand, his legs or any other surface available.

One does not have to see the instrument since you know where your fingers are so you can play the device without looking to see where your hands or fingers are.

Many people like tapping their fingers to a drumbeat and would enjoy tapping their fingers to make a real drum sound.

In using the invention one can use the palm, fingers and thumb of the hand to produce sounds produced by the sound module.

The invention can be set up to play any of the available sounds from any of the piezoelectric disc locations in the glove without modifying the invention.

The invention is very easy to use and one can play a good rhythm in a matter of minutes after having put the gloves on.

Someone who already knows how to play the drums and knows the proper sequence of drumming events could master the invention quite easily.

The drum sound is only one of the types of sounds that can be produced using the invention and the invention can also be used produce any sound that is available on the sound module used.

There are nearly unlimited sounds that can be triggered by the invention.

The invention can be used in conjunction with MIDI sounds for composing music tracks on a computer.

1. The invention can be used for on stage performances. These are just some of possible the uses that come to mind.

With the addition of a miniature sound module, a flash drive to store different sound data and an FM transmitter to the invention, it could be wireless and the invention could be used by turning the radio to a specific frequency and play sounds through the radio across the room.

The invention could be used on stage where the user would be free to walk across the stage playing an instrument that might normally be too heavy to move.

Wireless technology is available and only needs to be incorporated into the invention.

An entire band of musicians can each use the invention on stage with no bulky cables attached.

Please consider that although I use the invention as a musical device in my specification of the preferred embodiment, that the signals produced by the invention can also be uses to trigger other types of events One might want to use this invention for communicating with someone who can't speak.

The number of sounds that can be generated are only limited to number of inputs a sound module offers and the number of impact points that one has the facility to manipulate and cause impact with.

Sounds that can be produced by a sound module are nearly unlimited and could be audible words or phrases.

The devices signals can also be used to activate devices such as a door opener or many other such devices.

The invention could be used in conjunction with a robot to sense whether it has touched something or whether something has touched it.

Please consider that although I use a glove in my specification of the preferred embodiment, the glove is not necessary for the invention to work.

The signal producing devices can be attached or held in place in other locations and by a different means, allowing the use of other parts of the body to be used for controlling the signal generating devices.

It is my belief that the invention with its preferred embodiment and associated embodiments has great merit and unlimited potential. Please judge the merit of my invention not on its preferred embodiment and associated embodiments, but based on the claims I have made.

I claim:

1. A system for translating physical contact with a surface into sounds, the system comprising:

a. one or more pressure sensitive piezoelectric sensors, each configured to generate an electrical signal in direct response to impact applied thereto when subjected to contact with the surface, wherein the electrical signal generated varies with variations in the level of impact associated with contacting the one or more pressure sensitive piezoelectric sensors to the surface;

b. a sound module capable of translating the variable electrical signals received from the one or more pressure sensitive piezoelectric sensors into one or more sounds;

c. a glove for retaining the one or more pressure sensitive piezoelectric sensors for selectable impact thereof with the surface, wherein the piezoelectric sensors are integrated in the glove; and d. a signal wire and a ground wire directly connecting the one or more pressure sensitive piezoelectric sensors through a junction box to the sound module without a switch therebetween for transferring the variable electrical signals from the one or more pressure sensitive piezoelectric sensors directly to the sound module.

2. The system of claim 1 wherein the one or more pressure sensitive piezoelectric sensors are pressure sensitive piezoelectric disks.

3. The system of claim 1 further comprising data storage means coupled to the sound module for storing the variable electrical signals, the translated variable electrical signals, the sounds or any combination thereof.

4. The system of claim 1 further comprising an amplifier coupled to the sound module.

5. The system of claim 1 wherein the sound module is configured to enable selection of an instrument to generate sound associated with the selected instrument based on the translated variable electrical signals.

6. The system of claim 5 wherein the selected instrument is a drum set.

7. The system of claim 1 wherein the sound module is configured to enable note selection based on the translated variable electrical signals.

8. The system of claim 1 wherein the sound module is configured to enable selection of the period of time that a generated sound plays.

9. The system of claim 1 wherein the sound module is configured to enable selection of decay of the generated sound.

10. The system of claim 1 wherein there are a plurality of pressure sensitive piezoelectric sensors and the sound module is configured to associate different ones of the pressure sensitive piezoelectric sensors with different sounds.

* * * * *